US008897682B2

(12) United States Patent
Oishi et al.

(10) Patent No.: US 8,897,682 B2
(45) Date of Patent: Nov. 25, 2014

(54) IMAGE FORMING APPARATUS HAVING TORQUE LIMITING MECHANICS AND INERTIA MEMBER

(75) Inventors: Takehiro Oishi, Kanagawa (JP); Takashi Hoshino, Kanagawa (JP); Nobuhiro Hiroe, Kanagawa (JP); Kiichiro Iijima, Kanagawa (JP); Junji Hanatani, Kanagawa (JP)

(73) Assignee: Fuji Xerox., Ltd., Tokyo (JP)

( * ) Notice: Subject to any disclaimer, the term of this patent is extended or adjusted under 35 U.S.C. 154(b) by 273 days.

(21) Appl. No.: 13/542,145

(22) Filed: Jul. 5, 2012

(65) Prior Publication Data

US 2013/0223902 A1 Aug. 29, 2013

(30) Foreign Application Priority Data

Feb. 23, 2012 (JP) ..... 2012-037382

(51) Int. Cl.
*G03G 15/20* (2006.01)

(52) U.S. Cl.
USPC ..... 399/313

(58) Field of Classification Search
USPC ..... 399/313, 312, 302, 303, 308
See application file for complete search history.

(56) References Cited

U.S. PATENT DOCUMENTS

| | | | | |
|---|---|---|---|---|
| 5,689,764 | A | 11/1997 | Fukuchi et al. | |
| 5,963,769 | A | 10/1999 | Emukai et al. | |
| 2008/0298856 | A1 * | 12/2008 | Koike | 399/302 |

FOREIGN PATENT DOCUMENTS

| | | | | |
|---|---|---|---|---|
| JP | 04221974 A | * | 8/1992 | G03G 15/01 |
| JP | A-08-320604 | | 12/1996 | |
| JP | A-10-268595 | | 10/1998 | |
| JP | A-11-52757 | | 2/1999 | |
| JP | 2001337538 A | * | 12/2001 | G03G 15/16 |
| JP | A-2001-337538 | | 12/2001 | |
| JP | A-2006-133816 | | 5/2006 | |
| JP | A-2008-76499 | | 4/2008 | |

* cited by examiner

*Primary Examiner* — Billy Lactaoen
(74) *Attorney, Agent, or Firm* — Oliff PLC

(57) ABSTRACT

An image forming apparatus includes an image holding member on which an image is held, and a transfer unit transferring the held image to a recording material, wherein the transfer unit includes, a transfer roll disposed to be opposite to the image holding member, forming a transfer electric field, and transferring the image to the recording material, a drive unit applying driving force to the transfer roll, a torque limiting machanics limiting an upper limit of torque which acts on the transfer roll, and an inertia member provided to increase an amount of inertia with respect to the transfer roll and moving the transfer roll with inertia in a direction in which a speed difference between the image holding member and the transfer roll is decreased when the upper limit of torque acts on the transfer roll.

13 Claims, 15 Drawing Sheets

IMAGE FORMING APPARATUS HAVING TORQUE LIMITING MECHANICS AND INERTIA MEMBER

CROSS-REFERENCE TO RELATED APPLICATIONS

This application is based on and claims priority under 35 USC 119 from Japanese Patent Application No. 2012-037382 filed Feb. 23, 2012.

BACKGROUND

Technical Field

The present invention relates to an image forming apparatus.

SUMMARY

According to an aspect of the present invention, there is provided an image forming apparatus including: an image holding member on which an image is held; and a transfer unit that transfers the image held on the image holding member to a recording material, wherein the transfer unit includes: a transfer roll that is disposed so as to be opposite to the image holding member, forms a transfer electric field between the transfer roll and the image holding member, and transfers the image of the image holding member to the recording material; a drive unit that applies driving force to the transfer roll; a torque limiting mechanics that is provided between the drive unit and the transfer roll and limits an upper limit of torque which acts on the transfer roll; and an inertia member that is provided so as to increase an amount of inertia with respect to the transfer roll and moves the transfer roll with inertia in a direction in which a speed difference between the image holding member and the transfer roll is decreased when the upper limit of torque acts on the transfer roll in the torque limiting mechanics.

BRIEF DESCRIPTION OF THE DRAWINGS

Exemplary embodiments of the present invention will be described in detail based on the following figures, wherein.

DETAILED DESCRIPTION

Outline of Exemplary Embodiment

Figure 1A:
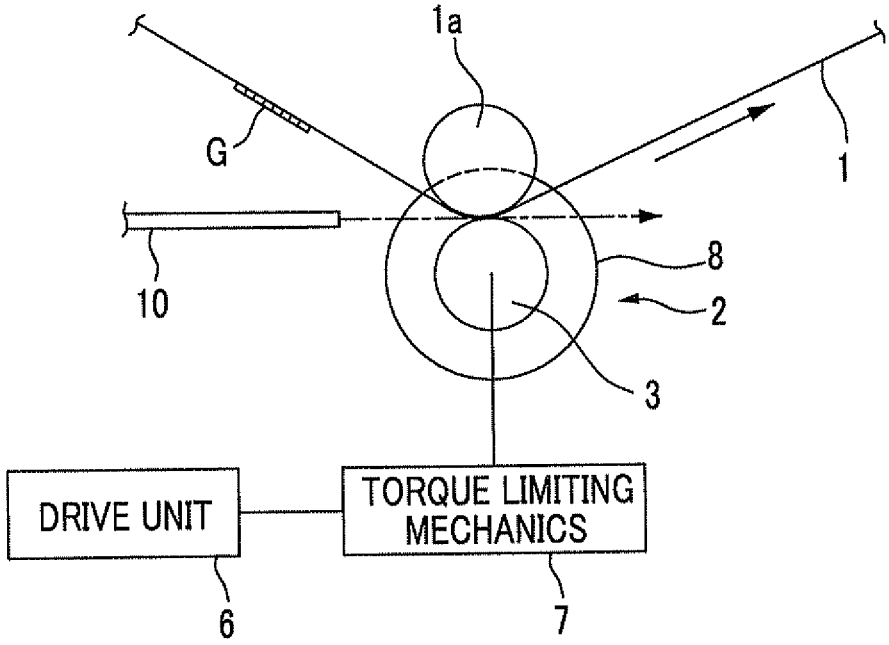
FIG. 1A is an explanatory diagram showing one example of an outline of an exemplary embodiment of an image forming apparatus to which the present invention is applied.

FIG. 1A is an explanatory diagram showing one example of an outline of an exemplary embodiment of an image forming apparatus to which the present invention is applied.

In FIG. 1A, the image forming apparatus includes an image holding member 1 on which an image G is held and a transfer unit 2 that transfers the image G held on the image holding member 1 to a recording material 10, wherein the transfer unit 2 includes a transfer roll 3 that is disposed so as to be opposite to the image holding member 1, forms a transfer electric field between the transfer roll 3 and the image holding member 1, and transfers the image G of the image holding member 1 to the recording material 10, a drive unit 6 that applies driving force to the transfer roll 3, a torque limiting mechanics 7 that is provided between the drive unit 6 and the transfer roll 3 and limits an upper limit of torque which acts on the transfer roll 3, and an inertia member 8 that is provided so as to increase an amount of inertia with respect to the transfer roll 3 and moves the transfer roll 3 with inertia in a direction in which a speed difference between the image holding member 1 and the transfer roll 3 is decreased when the upper limit of torque acts on the transfer roll 3 in the torque limiting mechanics 7.

Moreover, in FIG. 1A, the image holding member 1 is shown as a belt shape and a roll shaped opposite member 1*a* is provided between the image holding member 1 and the transfer roll 3. However, it is needless to say that the present invention is not limited thereto.

In terms of the technical measures, the image holding member 1 is not limited to an aspect which only includes an image forming and holding member forming and holding the image G. The image holding member includes an aspect which temporarily holds the image G on an intermediate transfer member before transferring the image G which is formed and held on the image forming and holding member to the recording material 10.

In addition, the transfer unit 2 includes a transfer roll 3 which is opposite to the image holding member 1, and for example, may include a belt type transfer unit having an aspect in which a belt is hung over the transfer belt 3 if having the aspect in which the inertial member 8 is added to the transfer roll 3.

In addition, the drive unit 6 may be separately independent from the drive unit of the image holding member 1 if applying the driving force to the transfer roll 3, or the drive unit 6 may be configured to be also used for the drive system of the image holding member 1.

In addition, the torque limiting mechanics 7 may be provided between the drive unit 6 and the transfer roll 3, a torque limiter may be provided in the transfer roll 3 or to be separate from the transfer roll 3, or an element (for example, an element which applies a current limit) which limits the torque acting on the transfer roll 3 in the drive unit 6 may be provided.

Moreover, a representative aspect of the inertia member 8 is a flywheel that is coaxial with the rotation axis of the transfer roll 3 or is provided on a transmission shaft connected via a transmitting member such as a gear train. However, the inertia member 8 may be appropriately selected if increasing the amount of inertia with respect to the transfer roll 3.

In addition, when the upper limit of torque acts on the transfer roll 3 in the torque limiting mechanics 7, the inertial member 8 needs to move the transfer roll 3 with inertia in the direction in which the speed difference between the image holding member 1 and the transfer roll 3 is decreased.

That is, since the transfer roll 3 and the image holding member 1 are driven with the speed difference, the upper limit of torque always acts on the transfer roll 3, and in normal times, the drive system of the image holding member 1 side takes charge of the driving while including the upper limit of torque. On the other hand, when a large load torque acts such as when a thick recording material 10 enters the transfer roll 3, the rotational speed of the transfer roll 3 is changed while not being capable of following the above-described load fluctuation due to the torque limiting mechanics 7. However, the amount of inertia due to the inertia member 8 acts on the transfer roll 3 according to the fluctuation, and the rotational speed fluctuation of the transfer roll 3 is decreased.

Therefore, in the present aspect, when a thick recording material 10 enters the transfer portion, insufficient torque with respect to the transfer roll 3 is compensated for by a friction force due to the inertia, and the recording material 10 is drawn into the transfer portion.

Figure 1B:
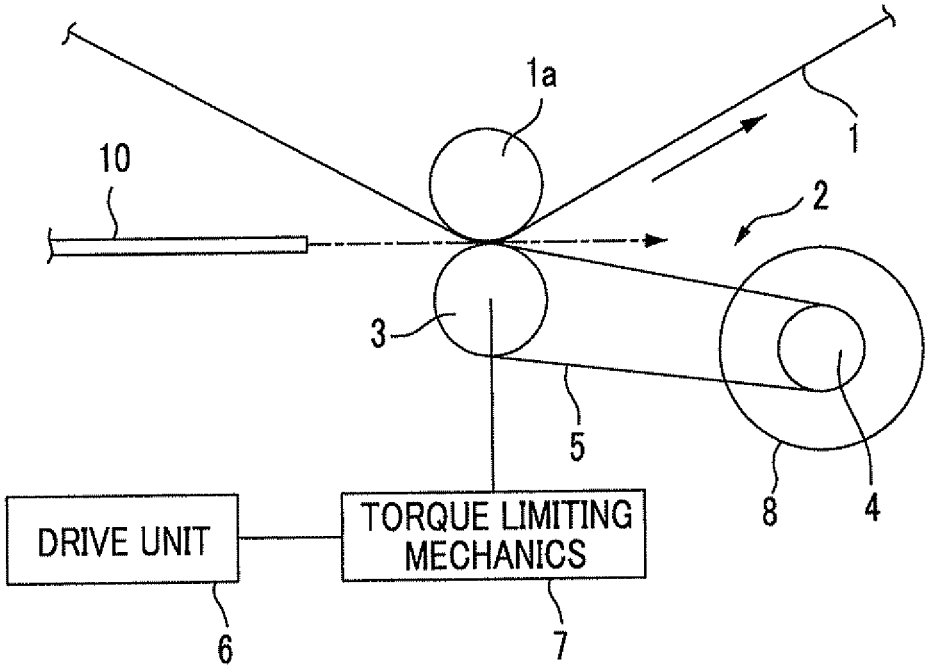
FIG. 1B is an explanatory diagram showing another example of the outline of the exemplary embodiment.

Moreover, FIG. 1B shows another example of the outline of the exemplary embodiment of the image forming apparatus to which the present invention is applied.

In FIG. 1B, the image forming apparatus includes the image holding member 1 on which the image G is held and the transfer unit 2 that transfers the image G held on the image holding member 1 to the recording material 10, wherein the transfer unit 2 includes the transfer roll 3 that is disposed so as to be opposite to the image holding member 1, forms a transfer electric field between the transfer roll 3 and the image holding member 1, and transfers the image G of the image holding member 1 to the recording material 10, the drive unit 6 that applies driving force to the transfer roll 3, one or plural tension rolls 4 that are disposed so as to be separated from the transfer roll 3 and are provided so as to be rotatably driven, a transfer belt 5 that is hung over the transfer roll 3 and the tension roll 4 and circulates through the drive rotation of the transfer roll 3, a torque limiting mechanics 7 that is provided between the drive unit 6 and the transfer roll 3 and limits an upper limit of torque which acts on the transfer roll 3, and an inertia member 8 that is provided so as to increase an amount of inertia with respect to at least one of the tension rolls 4 and moves the tension roll 4 with inertia in a direction in which a speed difference between the image holding member 1 and the transfer belt 5 is decreased when the upper limit of torque acts on the transfer roll 3 in the torque limiting mechanics 7.

The present example is an aspect in which the inertia member 8 is added to the tension roll 4 other than the transfer roll 3 while assuming the aspect which uses the belt type transfer unit 2.

Here, components similar to those of FIG. 1A are as described above. However, unlike FIG. 1A, in the present example, when the upper limit of torque acts on the transfer roll 3, the amount of inertia due to the inertia member 8 is transmitted to the transfer belt 5 via the tension roll 4, and the transfer belt 5 moves in the direction in which the speed difference between the image holding member 1 and the transfer belt 5 is decreased.

Moreover, since the inertia member 8 is provided in the tension roll 4 other than the transfer roll 3, compared to the aspect in which the inertia member 8 is added to the transfer roll 3, a degree of freedom for an installation space of the inertia member 8 is increased, and the setting of the amount of inertia due to the inertia member 8 can be easily performed.

Next, the representative aspect or the desirable aspect of the components in the present exemplary embodiment will be described.

First, as a representative aspect of the torque limiting mechanics 7, there is a mechanics that uses a torque limiter. Here, as the torque limiter, there is not only an aspect in which the torque limiter is directly provided between a drive shaft from the drive unit 6 and a spindle of the transfer roll 3 or is indirectly provided via a drive transmitting member such as a gear train but also an aspect in which the torque limiter is incorporated into the transfer roll 3.

Moreover, as another representative aspect of the torque limiting mechanics 7, there is one which sets an upper limit of a driving current of a motor which is the drive unit 6 and limits the upper limit of the torque acting on the transfer roll 3. Specifically, a current control method of the motor which is the drive unit 6 is to perform a limitation on current corresponding to the upper limit of torque acting on the transfer roll 3.

Moreover, as the representative aspect of the inertia member 8, there is a flywheel that is provided so as to be coaxial with the support shaft of the transfer roll 3 or the tension roll 4 or is provided to the transmission shaft connected via the transmitting member. The flywheel is not limited to a discoid if having a shape which increases the amount of inertia with respect to the transfer roll 3 or the tension roll 4 and is substantially uniformly rotated, and such as a shape having uniform cutout portions around the disk may be appropriately selected.

In addition, as the desirable aspect of the belt type transfer unit shown in FIG. 1B, there is an aspect in which the inertia member 8 is provided in the tension roll 4 having a smaller diameter than that of the transfer roll 3. If the inertia member 8 is added to the tension roll 4 having a smaller diameter than that of the transfer roll 3 like the present aspect, it is possible to further increase a rate of increase of the amount of inertia compared to a case where the inertia member 8 is added to the transfer roll 3.

Moreover, as another desirable aspect of the belt type transfer unit, there is an aspect in which the transfer belt 5 is formed of a resin or includes a metallic belt member. The present aspect is desirable in that the inertia action due to the inertia member 8 is transmitted to the transfer belt 5 via the tension roll 4 and the transfer belt 5 applies the inertia to the transfer roll 3 as an approximately rigid member.

Moreover, in the present aspect, as the recording material 10, a recording material having a basis weight of about 300 gsm or more may be used.

Hereinafter, the present invention will be described in more detail based on exemplary embodiments shown in the accompanying drawings.

Exemplary Embodiment 1

Overall Configuration of Image Forming Apparatus

Figure 2:
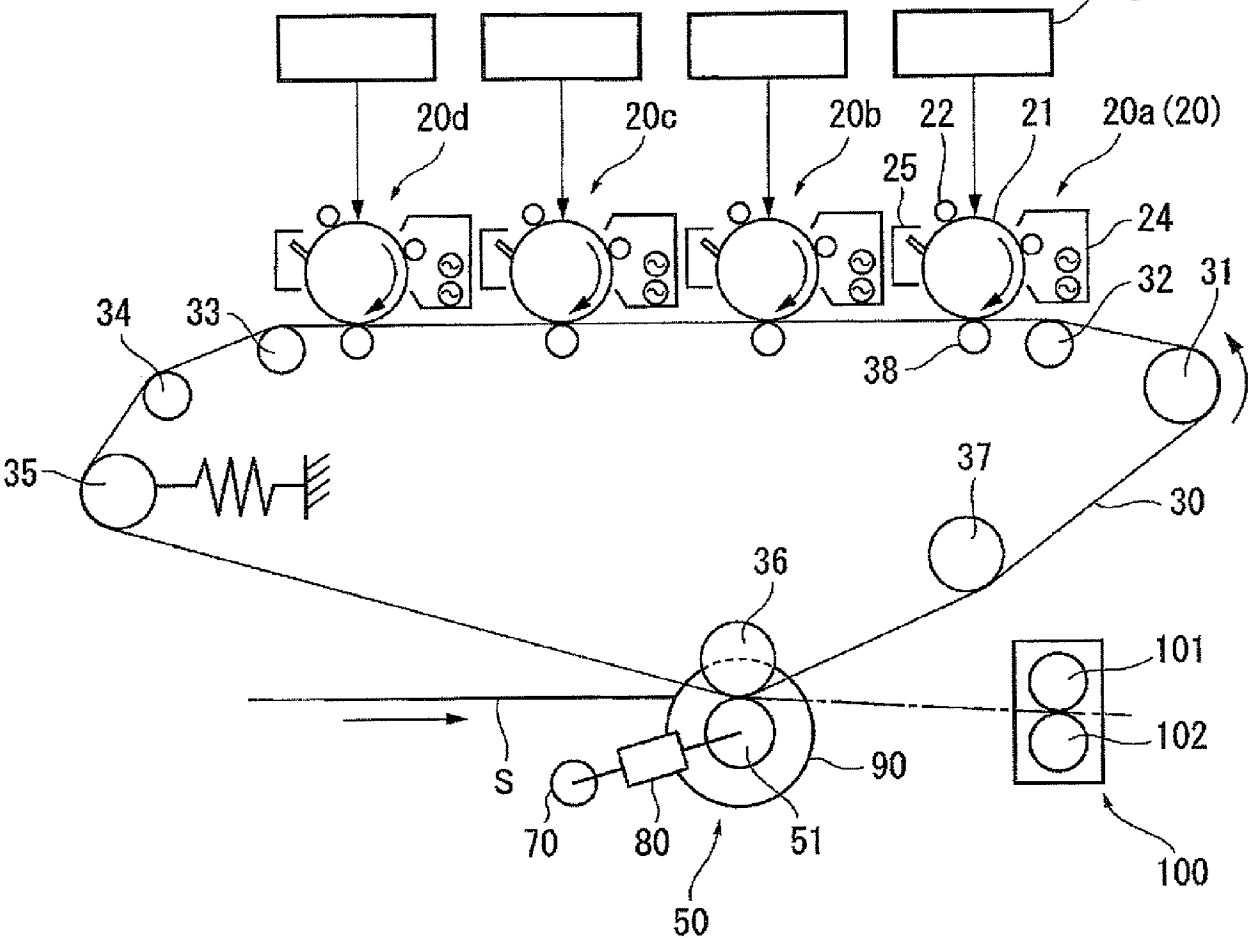
FIG. 2 is an explanatory diagram showing an overall configuration of an image forming apparatus according to Exemplary Embodiment 1.

FIG. 2 is an explanatory diagram showing an overall configuration of an intermediate transfer type image forming apparatus according to Exemplary Embodiment 1.

In FIG. 2, in the intermediate transfer type image forming apparatus, an image forming unit 20 (specifically, 20*a* to 20*d*) is disposed in parallel as four image forming portions in which images of plural color components (magenta (M), cyan (C), yellow (Y), and black (K) in the present example) may be formed, an intermediate transfer belt 30 is disposed below each image forming unit 20, after the image of each color component formed on each image forming unit 20 is primarily transferred to the intermediate transfer belt 30, the image of each color component on the intermediate transfer belt 30 is collectively transferred to paper S, which is the recording material, in a batch transfer unit (secondary transfer unit) 50, and an unfixed image on the paper S is fixed at a fixing device 100.

In the exemplary embodiment, each image forming unit 20 includes a drum shaped photoconductor 21 that rotates in a predetermined direction, and a charging device 22 that charges the photoconductor 21, an exposure device 23 that writes an electrostatic latent image on the charged photoconductor 21, a developing device 24 that develops the electrostatic latent image on the photoconductor 21 in the corresponding color component toner, and a cleaning device 25 that cleans off the residual toner on the photoconductor 21 are disposed around the photoconductor 21.

Here, the photoconductor 21 forms a photosensitive layer on a surface of a cylindrical substrate which is electrically grounded, and an organic photosensitive material, an amorphous selenium based photosensitive material, an amorphous silicon based photosensitive material, and the like are used in the photosensitive layer. Moreover, for example, the charging device 22 is a charging roll in which a coating of a high resistance material is formed on a metal roll having electrical conductivity such as stainless steel or aluminum, and the charging device 22 abuts the photoconductor 21 and is rotatably driven. A predetermined charged voltage is applied, therefore, continuous discharge is generated in a minute gap in the vicinity of a contact portion between the charging device 22 and the photoconductor 21, and the surface of the photoconductor 21 is substantially uniformly charged. In addition, for example, the exposure device 23 is a laser scanning device that radiates a laser light based on the image signal and write-scans the laser light in a main scanning direction of the photoconductor 21, and thereby, the electrostatic latent image is formed on the surface of the photoconductor 21. Moreover, the developing device 24 transfers a color toner which corresponds to the electrostatic latent image corresponding to each color component and forms a visible image, and a two-component developing or a single component developing may be used as the developing method. In addition, for example, an aspect in which a plate shaped cleaning member abuts the photoconductor 21 is used as the cleaning device 25. However, the present invention is not limited thereto, and the cleaning device may be appropriately selected, which includes a method using a brush shaped cleaning member.

In addition, the intermediate transfer belt 30 is hung over so as to circulate around plural (seven in the present example) tension rolls 31 to 37. In the present example, for example, as the intermediate transfer belt 30, a belt member in which carbon black and the like are kneaded to polyimide resin and which has a volume resistivity of about $10^6$ to $10^{15}$ Ω·cm is used. Moreover, for example, the tension roll 31 is a drive roll and the other tension rolls 32 to 37 are driven rolls.

Here, among the tension rolls 32 to 37, particularly, the tension rolls 32 and 33 work as a position regulating rolls that regulate the disposed position of the intermediate transfer belt 30 opposite to each photoconductor 21, the tension roll 35 works as a tension applying roll that applies the tension to the intermediate transfer belt 30, and the tension roll 36 works as a roll which is opposite to a secondary transfer unit (batch transfer unit) 50 described below.

Moreover, a primary transfer unit 38 is disposed on the rear surface side of the intermediate transfer belt 30 opposite to the photoconductor 21 of each image forming unit 20, and the primary transfer unit transfers the image of each color component on the photoconductor 21 to the intermediate transfer belt 30. The primary transfer unit 38 includes a primary transfer roll that is disposed so as to contact the rear surface side of the intermediate transfer belt 30. Moreover, a predetermined primary transfer voltage is applied to the primary transfer roll, and a primary transfer electric field in which the image of each color component on the photoconductor 21 may be electrostatically transferred is formed.

In addition, a belt cleaning device (not shown) is provided on the portion opposite to the tension roll 31 of the intermediate transfer belt 30, and the cleaning device cleans off the residual toner on the intermediate transfer belt 30.

Secondary Transfer Unit (Batch Transfer Unit)

Figure 3:
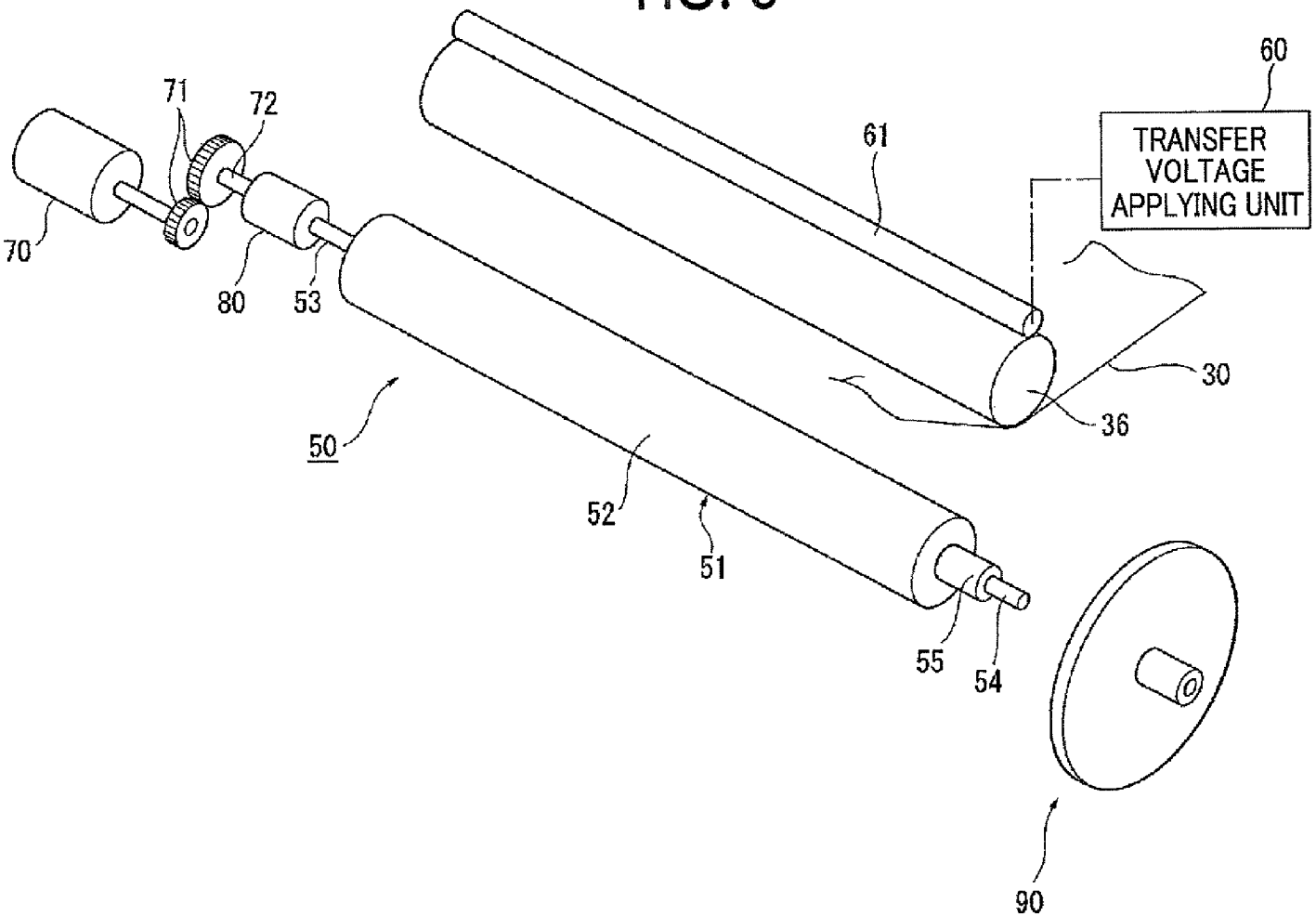
FIG. 3 is an explanatory diagram showing details of a transfer unit which is adopted in Exemplary Embodiment 1.

For example, as shown in FIGS. 2 and 3, in the secondary transfer unit (batch transfer unit) 50 which is used in the present exemplary embodiment, a secondary transfer roll 51 is disposed so as to contact the surface of the intermediate transfer belt 30 while having the tension roll 36 of the intermediate transfer belt 30 as the opposite roll. In addition, for example, a transfer voltage applying unit 60 is connected to the tension roll 36, which is the opposite roll, via a power supply roll 61, a predetermined secondary transfer voltage is applied to the tension roll 36, the secondary transfer roll 51 is grounded, and therefore, a secondary transfer electric field is formed between the secondary transfer roll 51 and the tension roll 36.

Here, for example, the surface of the secondary transfer roll 51 is formed of a tube of urethane rubber in which carbon is dispersed, and the inner portion of the secondary transfer roll is formed of urethane foam rubber in which carbon is dispersed. In addition, a fluorine coating is formed on the surface of the secondary transfer roll, and the secondary transfer roll is configured so that the volume resistivity is $10^3$ to $10^{10}$ Ω·cm.

Drive System

In addition, the secondary transfer roll 51 includes support shafts 53 and 54 that are rotatably supported at both ends of a roll main member 52, and for example, a driving force from a motor 70 which is a drive unit is transmitted to the support shaft 53 of the secondary transfer roll 51 via a drive transmission gear train 71 which is a drive transmission mechanics.

Here, a stepping motor or a DC motor is used as the motor 70.

In the present exemplary embodiment, the intermediate transfer belt 30 and the secondary transfer roll 51 are disposed so as to contact each other in a state where the intermediate transfer belt and the second transfer roll are driven together. However, in order to prevent the drive control from being unstable, the secondary transfer roll 51 is driven while having a speed difference between the secondary transfer roll 51 and the intermediate transfer belt 30.

However, if the speed difference is large, since the image is rubbed through the toner and image disturbance is generated at the time of the transfer operation of the secondary transfer unit 50, a torque limiter 80 described below is used for decreasing the above-described speed difference.

Torque Limiter

The support shaft 53 of the secondary transfer roll 51 is connected to an output shaft 72 of the drive transmission gear train 71 via the torque limiter 80.

Figure 4A:
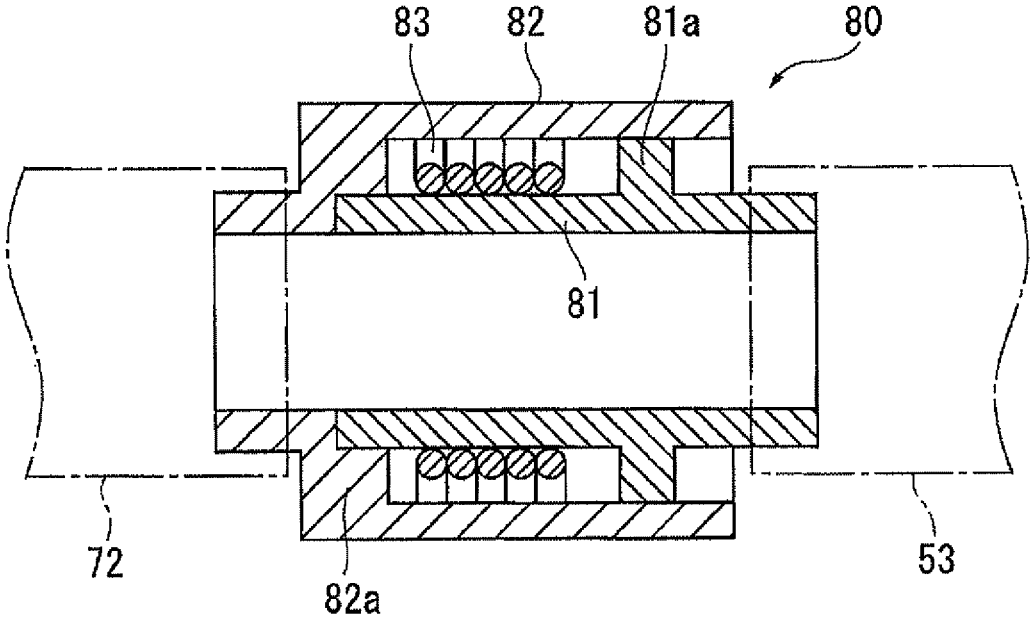
FIG. 4A is an explanatory diagram showing an example of a torque limiter which is used in the present exemplary embodiment.

In the present example, for example, as shown in FIG. 4A, the torque limiter 80 includes an inner ring 81 that is mounted so as to be coaxially fitted to the support shaft 53 of the secondary transfer roll 51, an outer ring 82 that is provided so as to cover around the inner ring 81 and is mounted so as to be coaxially fitted to the outer shaft 72 of the drive transmission gear train 71, and a spring material 83 that is press-fitted between the inner ring 81 and the outer ring 82 and is an elastic member applying a pressing force to the inner ring 81, and the upper limit of torque is set by the pressing force due to the spring material 83. That is, for example, when the load torque acts on the secondary transfer roll 51, if the torque acting on the torque limiter 80 is equal to or less than the upper limit of torque, the inner ring 81 and the outer ring 82 are integrally rotated. On the other hand, if the load torque exceeds the upper limit of torque, the restrained state between the inner ring 81 and the outer ring 82 is released by the spring material 83, and the inner ring 81 is slidably rotated with respect to the outer ring 82. In addition, in FIG. 4A, a reference numeral 81*a* is a guide portion that is provided in a flange shape on the outer circumferential portion of the inner ring 81, contacts the inner circumferential surface of the outer ring 82, and concentrically guides the inner ring. In addition, a reference numeral 82*a* is a guide portion that is provided in a flange shape on the inner circumferential portion of the outer ring 82, contacts the outer circumferential surface of the inner ring 81, and concentrically guides the outer ring.

Here, as a method of setting the "upper limit of torque", there is a method in which the upper limit of torque is set considering a paper transport force (is better as the upper limit of torque is larger) for preventing sliding between the paper S and the secondary transfer roll 51, and a driving stability (is better as the upper limit of torque is smaller) due to the contact between the driving force due to a motor (not shown) of the intermediate transfer belt 30 side and the driving force due to the motor 70 of the secondary transfer roll 51 side.

Moreover, in the present exemplary embodiment, the torque limiter 80 using the spring material 83 is used. However, the present invention is not limited thereto. For example, it is needless to say that well-known methods such as a method which sets the upper limit of torque through a principle in which a magnetic field through a magnet acts on a magnetic material may be appropriately selected. Moreover, the torque limiter 80 used in the present exemplary embodiment is adopted as a separated component. However, the present invention is not limited thereto. For example, it is needless to say that the torque limiter may be integrally incorporated into the secondary transfer roll 51 or the gear of the drive transmission gear train 71.

Flywheel

Figure 4B:
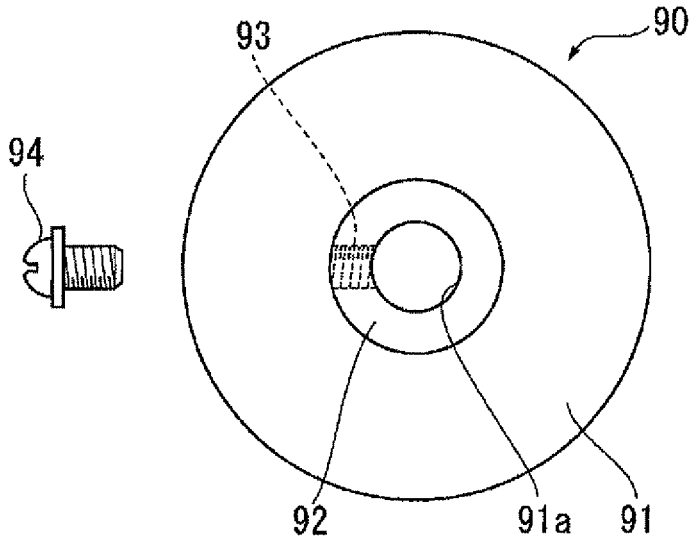
FIG. 4B is an explanatory diagram showing an example of a flywheel which is used in the present exemplary embodiment.

In addition, as shown in FIG. 3, a flywheel 90 which is an inertia member for increasing the amount of inertia with respect to the secondary transfer roll 51 is provided on the support shaft 54 of the other side of the secondary transfer roll 51. In the present example, as shown in FIG. 4B, the flywheel 90 includes a discoidal wheel main member 91 having an insertion hole 91*a* to which the support shaft 54 of the secondary transfer roll 51 is inserted and a tubular mounting block 92 that is coaxially fixed to the wheel main member 91. While a screw hole 93 is opened to a portion of the mounting block 92, a mounting screw 94 is screwed to the screw hole 93, the end of the mounting screw 94 is pressed to the support shaft 54, and thereby, the wheel main member 91 is fixed to the support shaft 54, and the flywheel is mounted to the secondary transfer roll 51. Moreover, a stepped portion 55 for positioning the mounting position of the flywheel 90 is provided between the roll main member 52 of the secondary transfer roll 51 and the support shaft 54.

In the present aspect, the flywheel 90 is mounted so as to be coaxial with the support shaft 54 of the secondary transfer roll 51. However, for example, a transmission shaft which is connected to the support shaft 54 of the secondary transfer roll 51 through a drive transmission gear train or the like is provided, and the flywheel 90 may be mounted to the transmission shaft. Alternatively, the flywheel 90 may be mounted so as to be coaxial with the support shaft 53 of the other side of the secondary transfer roll 51 or may be mounted to a transmission shaft which is connected through a drive transmission gear train or the like.

In addition, the shape or the mounting structure of the flywheel 90 is not limited to the above-described aspects, and it is needless to say that the shape or the mounting structure may be appropriately selected.

Here, as the setting of the amount of inertia of the flywheel 90, when the drive torque of the motor 70 which is a drive unit is driven so to be corresponding to the upper limit of torque of the torque limiter 80, the upper limit may be set as an amount of inertia within a range in which the secondary transfer roll 51 to which the flywheel 90 is attached is stably rotated.

Moreover, in the present exemplary embodiment, for example, the fixing device 100 includes a heat fixing roll 101 in which the surface is heated by a heater which is a heat source and is rotated so as to contact an unfixed image on the paper S, and a pressure fixing roll 102 that is disposed so as to be opposite to the heating fixing roll 101 and is pressed and rotated so as to interpose the paper S between the pressure fixing roll 102 and the heat fixing roll 101, and the unfixed image on the paper S is heated, pressurized, and fixed on the contact area of the heat fixing roll 101 and the pressure fixing roll 102.

Operation of Image Forming Apparatus

Next, an operation of the image forming apparatus according to the present exemplary embodiment will be described.

As shown in FIG. 2, in the image forming apparatus, if an imaging processing through each image forming unit 20 (20*a* to 20*d*) starts, the image of each color component is formed on the photoconductor 21 of each image forming unit 20, the image of each color component is primarily transferred to the intermediate transfer belt 30 through each primary transfer unit 38, the image G of each color component (refer to FIG. 5A) which is transferred to the intermediate transfer belt 30 is integrally transferred to the paper S in the secondary transfer unit (batch transfer unit) 50, and thereafter, the unfixed image on the paper S is fixed at the fixing device 100.

Figure 5A:
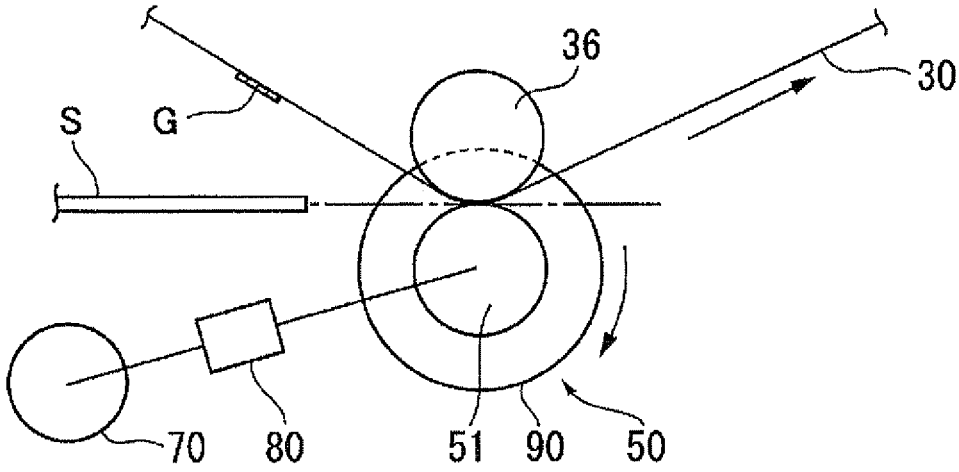
FIG. 5A is an explanatory diagram showing a state where paper enters a transfer portion of a transfer unit which is used in the present exemplary embodiment.
Figure 5B:
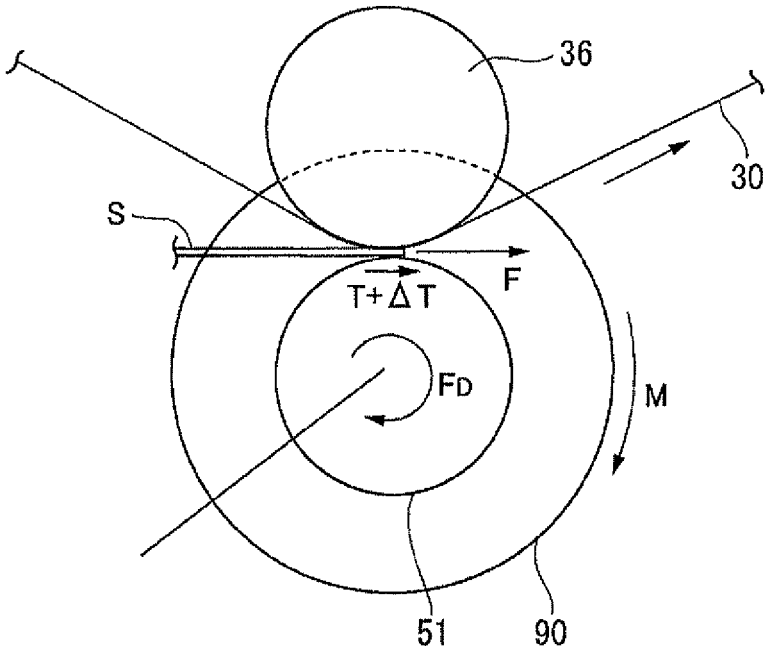
FIG. 5B is an explanatory diagram showing behavior when the paper has entered the transfer portion of the transfer unit.

In the imaging processing, as shown in FIGS. 5A and 5B, the driving force from the motor 70 is transmitted to the secondary transfer roll 51 of the secondary transfer unit 50 via the torque limiter 80, and a moment of inertia M due to the flywheel 90 according to the rotation of the secondary transfer roll 51 acts.

In this state, assuming a state where the paper S enters the transfer portion of the secondary transfer unit 50 as a recording material, as shown in FIGS. 5A and 5B, load fluctuation is generated in the secondary transfer roll 51 due to the entering of the paper S into the transfer portion.

At this time, in a case where paper having a small basis weight assumed in advance (for example, paper having a basis weight of 200 gsm or less) is used as the paper S, the load fluctuation due to the entering of the paper S into the transfer portion is only within the range assumed in advance, the load exceeding the upper limit of torque does not act on the torque limiter 80 connected to the secondary transfer roll 51, and the driving force from the motor 70 is transmitted to the secondary transfer roll 51. Thereby, the paper S is drawn into the transfer portion according to the drive rotation of the secondary transfer roll 51 and smoothly passes through the transfer portion.

On the other hand, in a case where the paper S having a large basis weight assumed in advance (for example, paper having basis weight exceeding 200 gsm) is used as the paper S, the load fluctuation due to the entering of the paper S into the transfer portion exceeds the range assumed in advance, and the load exceeding the upper limit of torque may act on the torque limiter 80 connected to the secondary transfer roll 51.

At this time, since the driving force from the motor 70 is transmitted to the secondary transfer roll 51 in the state of being limited to the upper limit of torque by the torque limiter 80, the load fluctuation due to the entering of the paper S into the transfer portion may not be absorbed only by the rotation driving force of the secondary transfer roll 51, and a drawing force F for drawing the paper S which enters the transfer portion may be insufficient.

However, since the flywheel 90 is provided on the secondary transfer roll 51, the moment of inertia M due to the flywheel 90 acts toward the rotation direction of the secondary transfer roll 51, and a torque increase ΔT due to the moment of inertia M acts on the secondary transfer roll 51. In this state, since the torque increase ΔT due to the moment of inertia M in addition to the torque T due to the rotation driving force acts on the secondary transfer roll 51, even though the paper S having a large basis weight enters the transfer portion, if the torque increase ΔT due to the moment of inertia M is set sufficiently to eliminate a shortfall of the drawing force F of the paper S according to the load fluctuation, when the paper S enters the transfer portion, the paper S is reliably drawn into the transfer portion and smoothly passes through the transfer portion due to the torque T due to the rotation driving force of the secondary transfer roll 51 and the torque increase ΔT due to the moment of inertia M.

Thereby, even though the paper S having a large basis weight enters the transfer portion, since the paper S stably passes through the transfer portion, the image disturbance is effectively avoided at the time of the transfer operation.

Moreover, in the present exemplary embodiment, the aspect in which the flywheel 90 is added only to the secondary transfer roll 51 of the secondary transfer unit 50 is shown. However, in addition to this, from the viewpoint of more stable transportability of the intermediate transfer belt 30, an inertia member such as the flywheel may be added to one or plural of the tension rolls 31 to 37 of the intermediate transfer belt 30.

In order to estimate performance of the secondary transfer unit 50 which is used in the present exemplary embodiment, a secondary transfer unit 50' according to Comparative Embodiments 1 and 2 will be described with reference to FIGS. 6A and 6B.

Comparative Embodiment 1

Figure 6A:
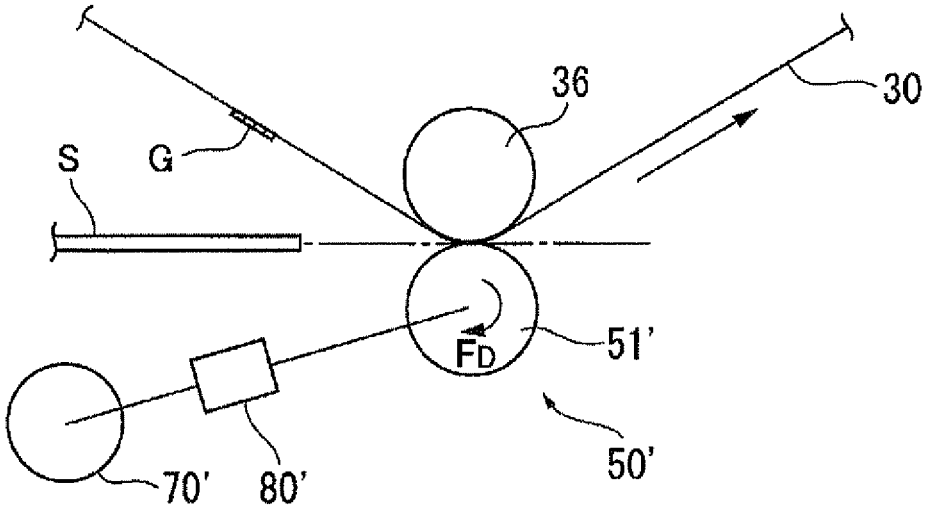
FIG. 6A is an explanatory diagram showing a transfer unit according to Comparative Embodiment 1.

As shown in FIG. 6A, in the secondary transfer unit 50' according to Comparative Embodiment 1, with respect to a secondary transfer roll 51', the drive system (motor 70', drive transmission gear train (not shown), and torque limiter 80') corresponding to the drive system of the secondary transfer unit 50 according to Exemplary Embodiment 1 is left, and the flywheel 90 is removed.

According to the present aspect, since the load fluctuation due to the entering of the paper S into the transfer portion is small when the paper S having a small basis weight enters the transfer portion of the secondary transfer unit 50', the behavior of the paper S due to the entering into the transfer portion through the rotation driving force of the secondary transfer roll 51' is stable.

However, since the load fluctuation due to the entering of the paper S is large when the paper S having a large basis weight enters the transfer portion, a possibility of the load fluctuation exceeding the upper limit of torque of the torque limiter 80' connected to the motor 70' is increased. If the load fluctuation exceeds the upper limit of torque of the torque limiter 80', since only a rotation driving force $F_D$ which is limited to the upper limit of torque of the torque limiter 80' acts on the secondary transfer roll 51', when the paper S enters the transfer portion, the drawing force which draws the paper S into the transfer portion is insufficient with only the rotation driving force $F_D$ of the secondary transfer roll 51'. Thereby, it is difficult to stably transport the paper S having a large basis weight to the transfer portion of the secondary transfer unit 50', which becomes a main cause of an image disturbance (for example, streaky pattern or the like which occurs along a direction crossing a transport direction of paper S).

Comparative Embodiment 2

Figure 6B:
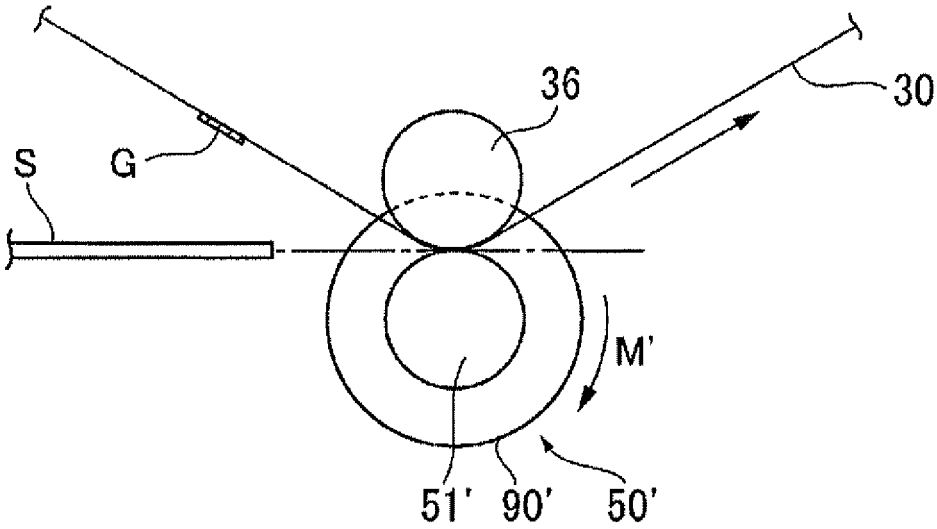
FIG. 6B is an explanatory diagram showing a transfer unit according to Comparative Embodiment 2.

As shown in FIG. 6B, in the secondary transfer unit 50' according to Comparative Embodiment 2, the drive system (motor 70, drive transmission gear train 71, and torque limiter 80) of the secondary transfer unit 50 according to Exemplary Embodiment 1 is removed, the secondary transfer roll 51' is configured as a driven roll which follows the movement of the intermediate transfer belt 30, and the flywheel 90' is added to the secondary transfer roll 51'.

In the present aspect, when the paper S having a small basis weight enters the transfer portion of the secondary transfer unit 50', if the load fluctuation due to the entering of the paper S into the transfer portion is a range which is smaller than the drawing force of the paper S due to the moment of inertia M' of the flywheel 90', the paper S is drawn into the transfer portion. However, if the paper S having a large basis weight is used and the load fluctuation due to the entering of the paper S into the transfer portion is increased, the load fluctuation may exceed the above-described drawing force of the paper S, and there is a concern that the transportability of the paper S entering the transfer portion may be damaged.

Therefore, in the present aspect, if the amount of inertia of the flywheel 90' is set to be large, the moment of inertia M' of the flywheel 90' may be set so as to be large. However, since the secondary transfer roll 51' in the present aspect is configured to be the driven roll which follows the movement of the intermediate transfer belt 30, for example, if the amount of inertia of the flywheel 90' is set to be too large, the following rotation itself of the secondary transfer roll 51' becomes difficult. Thereby, it is difficult to set a sufficiently large amount of inertia for the flywheel 90' which is added to the secondary transfer roll 51' of the driven roll configuration, and the paper having a large basis weight among the usable paper S is excluded.

Comparative Embodiment 3

Figure 6C:
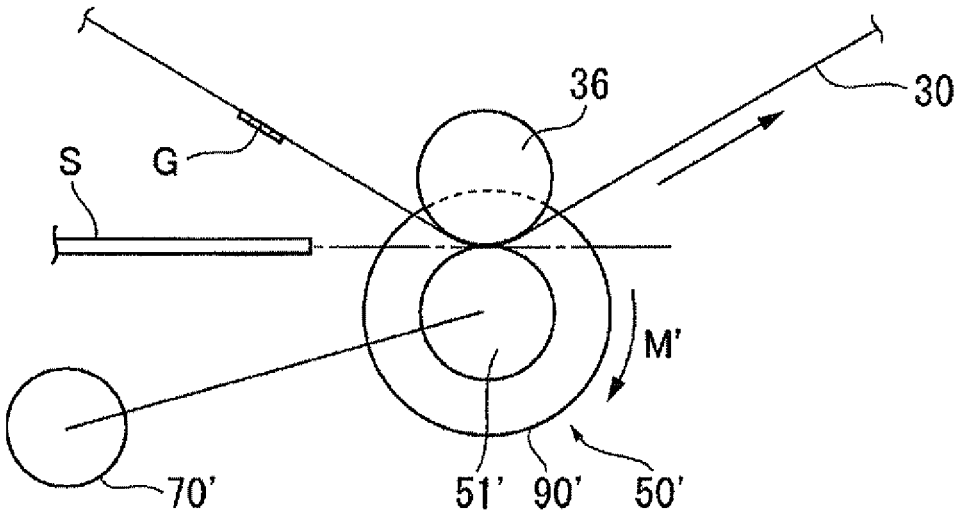
FIG. 6C is an explanatory diagram showing a transfer unit according to Comparative Embodiment 3.

As shown in FIG. 6C, in the secondary transfer unit 50' according to Comparative Embodiment 3, with respect to a secondary transfer roll 51', the drive system (motor 70' and drive transmission gear train (not shown)) in which the torque limiter 80 is removed from the drive system of the secondary transfer unit 50 according to Exemplary Embodiment 1 is used, and the flywheel 90' is added to the secondary transfer roll 51'.

In the present aspect, since the torque limiter 80 is not used as a torque limiting mechanics, the speed difference between the intermediate transfer belt 30 and the secondary transfer roll 51' may not be small, the transport control of the paper S becomes unstable, and there is a concern that the image disturbance may be generated.

Exemplary Embodiment 2

Figure 7A:
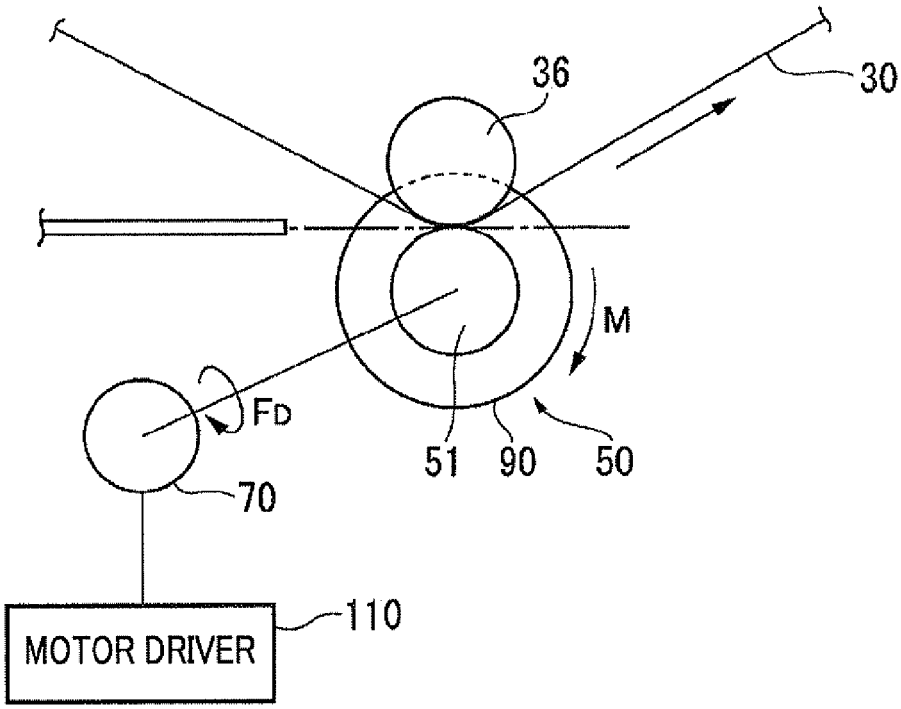
FIG. 7A is an explanatory diagram showing a main portion of an image forming apparatus according to Exemplary Embodiment 2.

FIG. 7A is an explanatory diagram showing a main portion of an image forming apparatus according to Exemplary Embodiment 2.

In FIG. 7A, the basic configuration of the image forming apparatus is approximately similar to that of Exemplary Embodiment 1. However, the image forming apparatus of Exemplary Embodiment 2 includes the secondary transfer unit 50 which is different from that of Exemplary Embodiment 1. Moreover, the components similar to those of Exemplary Embodiment 1 are denoted by reference numerals similar to those of Exemplary Embodiment 1, and detailed descriptions thereof are omitted.

In FIG. 7A, similar to Exemplary Embodiment 1, the secondary transfer unit 50 includes the secondary transfer roll 51, and the driving force from the motor 70 which is a drive unit is transmitted to the secondary transfer roll 51 via the drive transmission gear train (not shown) which is a drive transmission mechanics. However, unlike the torque limiter of Exemplary Embodiment 1, predetermined current characteristics are applied to the motor driver 110 for driving the motor 70.

Figure 7B:
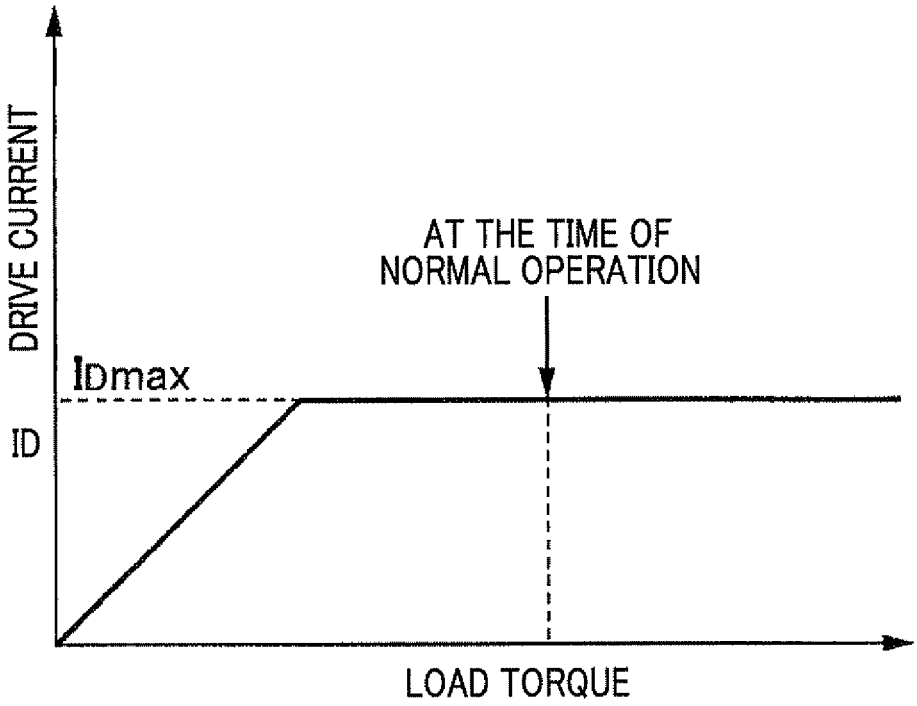
FIG. 7B is an explanatory diagram showing characteristics of a motor driver.

In the present exemplary embodiment, for example, the load torque acting on the secondary transfer roll 51 is changed due to the load fluctuation according to the entering of the paper S into the transfer portion of the secondary transfer unit 50. However, as shown in FIG. 7B, the current characteristics which are applied to the motor driver 110 are divided into a proportional current region I in which a driving current $I_D$ of the motor 70 proportionally increases according to the increase of the load torque and a constant current region II in which a constant current is maintained at a step of the load torque being equal to or more than a predetermined reference value, and any one of locations of the constant current region II is selected at the time of a normal operation.

Here, in order to apply the current characteristics to the motor driver 110, since the drive torque of the motor 70 is proportional to the driving current $I_D$, an upper limit $I_D$max of the driving current $I_D$ is set and the constant current may be controlled to the upper limit $I_D$max.

According to the present exemplary embodiment, the torque of the secondary transfer roll 51 is limited by the current characteristics of the motor driver 110, and the moment of inertia M due to the flywheel 90 acts on the secondary transfer roll 51.

Thereby, similar to the image forming apparatus according to Exemplary Embodiment 1, even though the load fluctuation is generated at the secondary transfer roll 51 due to the entering of the paper S into the transfer portion of the secondary transfer unit 50 and the above-described load fluctuation due to the use of the paper S having a large basis weight is increased to some extent, since the torque increase ΔT (refer to FIG. 5B) due to the moment of inertia M of the flywheel 90 acts on the secondary transfer roll 51 in addition to the torque T (refer to FIG. 5B) due to the rotation driving force $F_D$, the paper S entering the transfer portion is drawn into the transfer portion while having sufficient drawing force F (refer to FIG. 5B) and smoothly passes through the transfer portion.

Exemplary Embodiment 3

Figure 8:
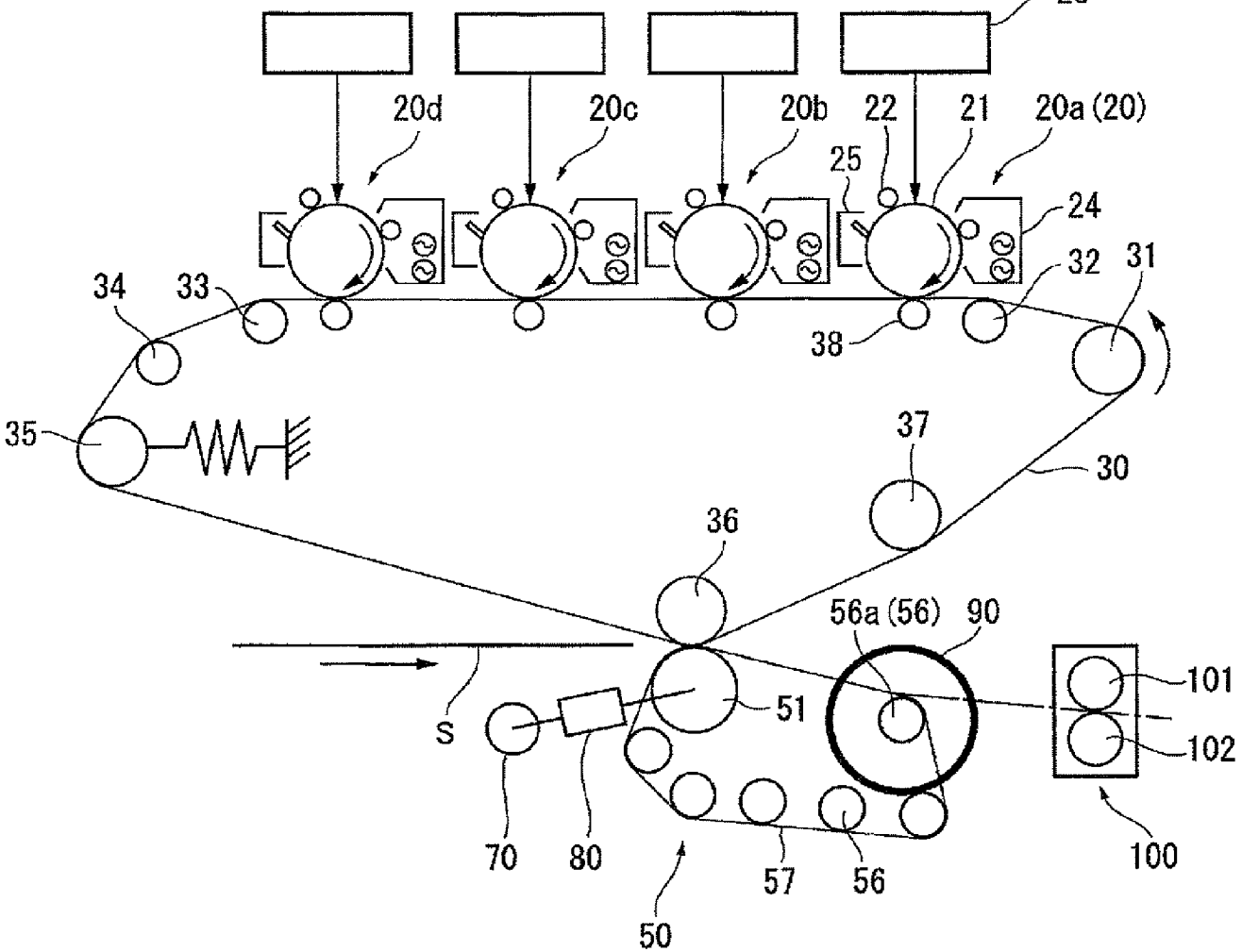
FIG. 8 is an explanatory diagram showing an overall configuration of an image forming apparatus according to Exemplary Embodiment 3.

FIG. 8 is an explanatory diagram showing an overall configuration of an image forming apparatus according to Exemplary Embodiment 3.

In FIG. 8, the image forming apparatus is configured so as to be approximately similar to that of Exemplary Embodiment 1. However, the image forming apparatus of Exemplary Embodiment 3 includes the secondary transfer unit 50 which is different from that of Exemplary Embodiment 1. Moreover, the components similar to those of Exemplary Embodiment 1 are denoted by reference numerals similar to those of Exemplary Embodiment 1, and detailed descriptions thereof are omitted.

Figure 9:
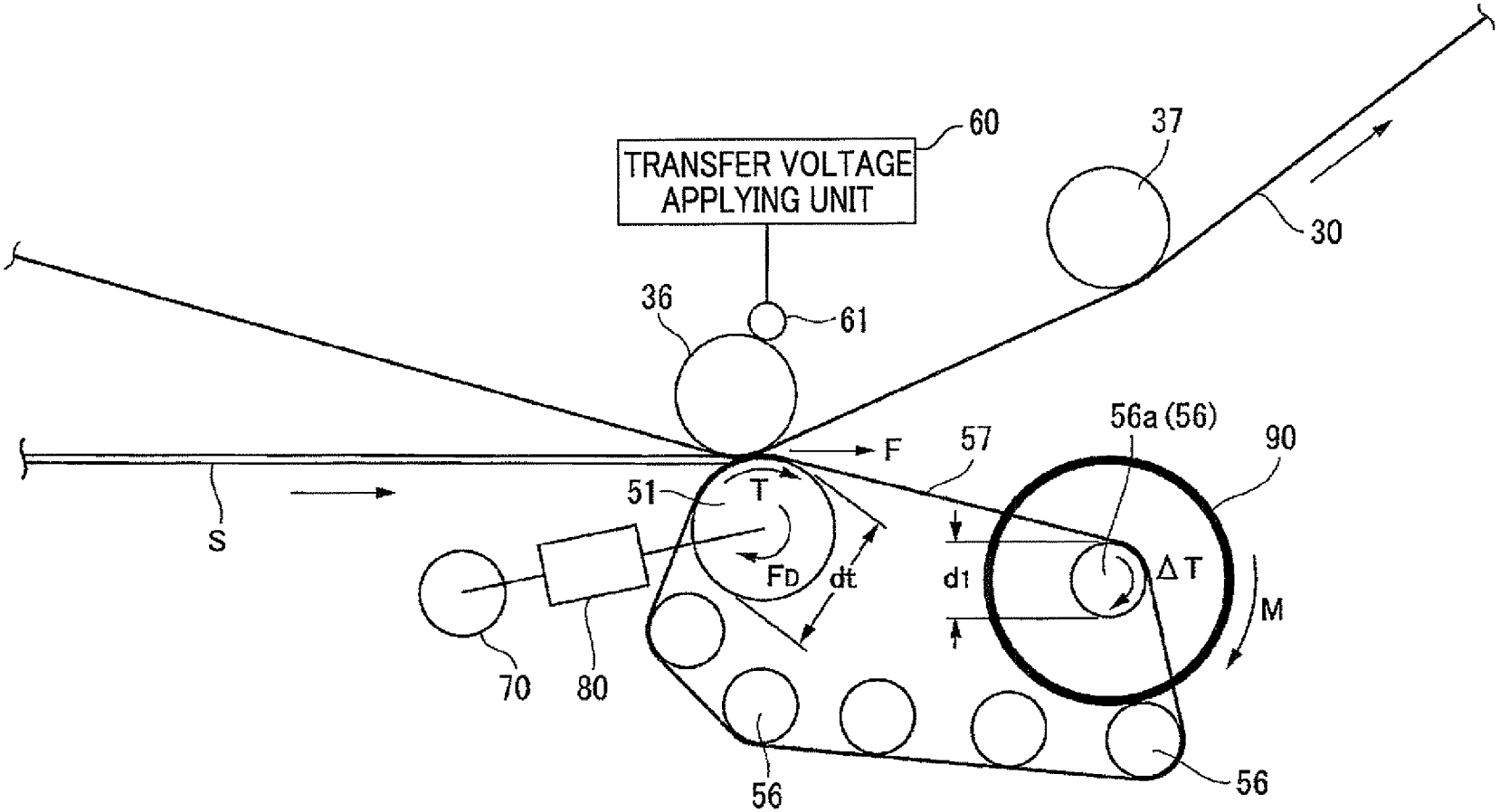
FIG. 9 is an explanatory diagram showing details of the transfer unit which is used in Exemplary Embodiment 3.

In the present exemplary embodiment, as shown in FIGS. 8 and 9, the secondary transfer unit 50 includes the secondary transfer roll 51 that is disposed so as to contact the surface of the intermediate transfer belt 30 while having the tension roll 36 of the intermediate transfer belt 30 as the opposite roll, plural (6 in the present example) tension rolls 56 that are disposed so as to be separated from the secondary transfer roll 51 and are provided so as to be rotatably driven, and the transfer belt 57 that is hung over the secondary transfer roll 51 and the plural tension rolls 56 and circulates according to the drive rotation of the secondary transfer roll 51.

Here, for example, the secondary transfer roll 51 is configured so that an elastic layer in which carbon black or the like is mixed into urethane foam rubber or EPDM is coated around a metal shaft. In addition, for example, each tension roll 56 is configured of a metal roll, and for example, the transfer belt 57 is configured of a belt of semi-electrical conductivity having the volume resistivity of about $10^6$ to $10^{12}$ Ω·cm which uses a belt base material made of resin of an approximately rigid member such as polyamide-imide.

In the present exemplary embodiment, similar to Exemplary Embodiment 1, in the secondary transfer unit 50, the transfer voltage applying unit 60 is connected to the tension roll 36 of the intermediate transfer belt 30, which is the roll which is opposite to the secondary transfer roll 51, via the power supply roll 61, and the secondary transfer roll 51 and the motor 70 which is a drive unit are connected to each other via the torque limiter 80 so as to be rotatably driven. However, unlike Exemplary Embodiment 1, among the plural tension rolls 56 which are rotatably driven, the flywheel 90 is provided on one support shaft of a tension roll 56*a* which is adjacent to the downward side in the movement direction of the transfer belt 57 with respect to the secondary transfer roll 51.

Particularly, in the present exemplary embodiment, a roll main member diameter $d_1$ of the tension roll 56*a* is set to be smaller than a roll main member diameter dt of the secondary transfer roll 51.

Next, an operation of the image forming apparatus according to the present exemplary embodiment will be described.

In the exemplary embodiment, as shown in FIG. 9, the driving force from the motor 70 is transmitted to the secondary transfer roll 51 of the secondary transfer unit 50 via the torque limiter 80.

In this state, the transfer belt 57 circulates according to the drive rotation of the secondary transfer roll 51, and each tension roll 56 turns around according to the movement of the transfer belt 57 and is driven to rotate. At this time, the flywheel 90 added to the tension roll 56*a* is rotated, and the moment of inertia M due to the flywheel 90 acts on the tension roll 56*a*.

In the operation course, assuming a case where the paper S which is a recording material enters the transfer portion of the secondary transfer unit 50, as shown in FIG. 9, the load fluctuation is generated at the transfer belt 57 and the secondary transfer roll 51 due to the entering of the paper S into the transfer portion.

At this time, in a case where paper S having a small basis weight assumed in advance (for example, paper having basis weight of 200 gsm or less) is used as the paper S, the load fluctuation due to the entering of the paper S into the transfer portion is only within the range assumed in advance, the load exceeding the upper limit of torque does not act on the torque limiter 80 connected to the secondary transfer roll 51, and the driving force from the motor 70 is transmitted to the secondary transfer roll 51. Thereby, the paper S is drawn into the transfer portion by the transfer belt 57 which circulates according to the drive rotation of the secondary transfer roll 51, and smoothly passes through the transfer portion.

On the other hand, in a case where the paper S having a large basis weight (for example, paper having basis weight exceeding 200 gsm) is used as the paper S, the load fluctuation due to the entering of the paper S into the transfer portion exceeds the range assumed in advance, the load exceeding the upper limit of torque may act on the torque limiter 80 connected to the secondary transfer roll 51.

At this time, since the driving force from the motor 70 is transmitted to the secondary transfer roll 51 in the state of being limited to the upper limit of torque by the torque limiter 80, the load fluctuation due to the entering of the paper S into the transfer portion may not be absorbed by only the moving force of the transfer belt 57 due to the rotation driving force $F_D$ of the secondary transfer roll 51, and the drawing force F for drawing the paper S which enters the transfer portion may be insufficient.

However, since the flywheel 90 is provided on the transfer roll 56*a*, the moment of inertia M due to the flywheel 90 acts toward the rotation direction of the tension roll 56*a*, and the torque increase ΔT due to the moment of inertia M acts on the transfer belt 57 via the tension roll 56*a* and acts on the secondary transfer roll 51 via the transfer belt 57.

In this state, since the torque increase ΔT due to the moment of inertia M of the flywheel 90 of the tension roll 56*a* in addition to the torque T due to the rotation driving force $F_D$ of the secondary transfer roll 51 acts on the transfer belt 57 corresponding to the transfer portion, even in the case where the paper S having a large basis weight enters the transfer portion, if the torque increase ΔT due to the moment of inertia M is set sufficiently to eliminate a shortage of the drawing force F of the paper S according to the load fluctuation, when the paper S enters the transfer portion, the paper S is reliably drawn into the transfer portion of the transfer belt 57 and smoothly passes through the transfer portion by the torque T due to the rotation driving force $F_D$ of the secondary transfer roll 51 and the torque increase ΔT due to the moment of inertia M.

Thereby, even though the paper S having a large basis weight enters the transfer portion, since the paper S stably passes through the transfer portion, the image disturbance is effectively avoided at the time of the transfer operation.

Particularly, in the present exemplary embodiment, since the flywheel 90 is added to the tension roll 56*a* unrelated to the secondary transfer roll 51, the installation space of the flywheel 90 is easily secured compared to the vicinity of the secondary transfer roll 51. In addition, since the flywheel 90 is added to the tension roll 56*a* having a smaller diameter than the secondary transfer roll 51, the rotational speed in the circumferential direction of the tension roll 56*a* is increased compared to that of the secondary transfer roll 51, and the torque increase ΔT due to the moment of inertia M of the flywheel 90 may be secured so as to be larger. Moreover, in the present example, for example, since the transfer belt 57 uses a belt base material made of resin of an approximately rigid member, when the torque increase ΔT due to the moment of inertia M of the flywheel 90 is transmitted to the transfer belt 57 via the tension roll 56*a*, the transfer belt 57 has almost no elastic deformation, and the torque increase ΔT is effectively transmitted to the transfer belt 57.

Moreover, in the present exemplary embodiment, the torque limiter 80 which is a torque limiting mechanics is used. However, the present invention is not limited thereto. For example, the motor driver 110 as shown in Exemplary Embodiment 2 may be used. In addition, in the present exemplary embodiment, the aspect in which the flywheel 90 is added only to the tension roll 56*a* is shown. However, the present invention is not limited thereto, and instead of or in addition to this, the inertia member such as the flywheel 90 may be added to another tension roll 56. Moreover, in addition to this, from the viewpoint of more stable transportability of the intermediate transfer belt 30, an inertia member such as the flywheel may be added to one or plural of the tension rolls 31 to 37 of the intermediate transfer belt 30.

Exemplary Embodiment 4

Figure 10:
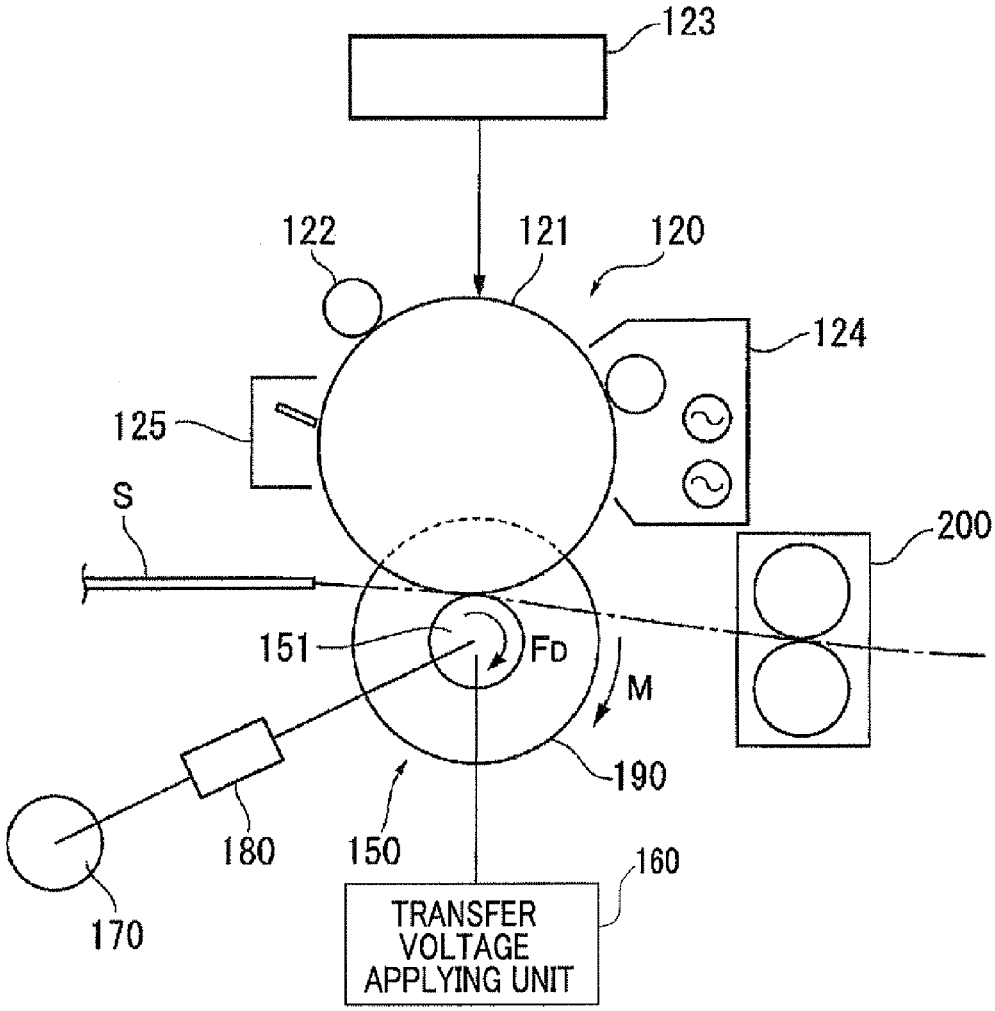
FIG. 10 is an explanatory diagram showing an overall configuration of an image forming apparatus according to Exemplary Embodiment 4.

FIG. 10 is an explanatory diagram showing a main portion of an image forming apparatus according to Exemplary Embodiment 4.

In FIG. 10, unlike Exemplary Embodiments 1 to 3, the image forming apparatus includes a single color image forming unit 120, a transfer unit 150 that transfers the image formed on the image forming unit 120 to the paper S which is a recording material, and a fixing device 200 that fixes an unfixed image which is transferred to the paper S in the transfer unit 150.

In FIG. 10, the image forming unit 120 includes a drum shaped photoconductor 121, and a charging device 122 that charges the photoconductor 121, an exposure device 123 that writes an electrostatic latent image on the charged photoconductor 121, a developing device 124 that develops the electrostatic latent image on the photoconductor 121 at a predetermined color component toner, and a cleaning device 125 that cleans off the residual toner on the photoconductor 121 are disposed around the photoconductor 121.

In addition, the transfer unit 150 includes a transfer roll 151 that is disposed so as to be opposite to the photoconductor 121, a transfer electric field is formed between the transfer roll 151 and the photoconductor 121 by connecting a transfer voltage applying unit 160 to the transfer roll 151, a motor 170 that is a drive unit is connected to the transfer roll 151 via a torque limiter 180 which is a torque limiting mechanics, and a flywheel 190 which is an inertia member is added to one support shaft of the transfer roll 151.

According to the present exemplary embodiment, as shown in FIG. 10, the image having a predetermined color component is formed on the photoconductor 121 of the image forming unit 120, the image of the color component is integrally transferred to the paper S in the transfer unit 150, thereafter, the unfixed image on the paper S is fixed at the fixing device 200.

In the imaging processing, the driving force from the motor 170 is transmitted to the transfer roll 151 of the transfer unit 150 via the torque limiter 180, and the moment of inertia M due to the flywheel 190 according to the rotation of the transfer roll 151 is operated.

In this state, assuming a state where the paper S which is a recording material enters the transfer portion of the transfer unit 150, load fluctuation is generated in the transfer roll 151 due to the entering of the paper S into the transfer portion.

At this time, in a case where the paper S having a small basis weight assumed in advance (for example, paper having basis weight of 200 gsm or less) is used as the paper S, according to the operation which is approximately similar to that of Exemplary Embodiment 1, the paper S is drawn into the transfer portion according to the drive rotation of the transfer roll 151 and smoothly passes through the transfer portion.

On the other hand, in a case where the paper S having a large basis weight (for example, paper having basis weight exceeding 200 gsm) is used as the paper S, according to the operation which is similar to that of Exemplary Embodiment 1, since the torque increase due to the moment of inertia M in addition to the torque due to the rotation driving force acts on the transfer roll 151, even though the paper S having a large basis weight enters the transfer portion, the torque increase due to the moment of inertia M eliminates a shortage of the drawing force of the paper S according to the load fluctuation, when the paper S enters the transfer portion, the paper S is reliably drawn into the transfer portion and smoothly passes through the transfer portion by the torque due to the rotation driving force of the transfer roll 151 and the torque increase due to the moment of inertia M.

Thereby, even though the paper S having a large basis weight enters the transfer portion, since the paper S stably passes through the transfer portion, the image disturbance is effectively avoided at the time of the transfer operation.

Moreover, in the present exemplary embodiment, the torque limiter 80 which is a torque limiting mechanics is used. However, the present invention is not limited thereto. For example, the motor driver 110 as shown in Exemplary Embodiment 2 may be used.

EXAMPLE

Example 1

The present example embodies the image forming apparatus according to Exemplary Embodiment 3.

Paper Type and Load Fluctuation

Figure 11:
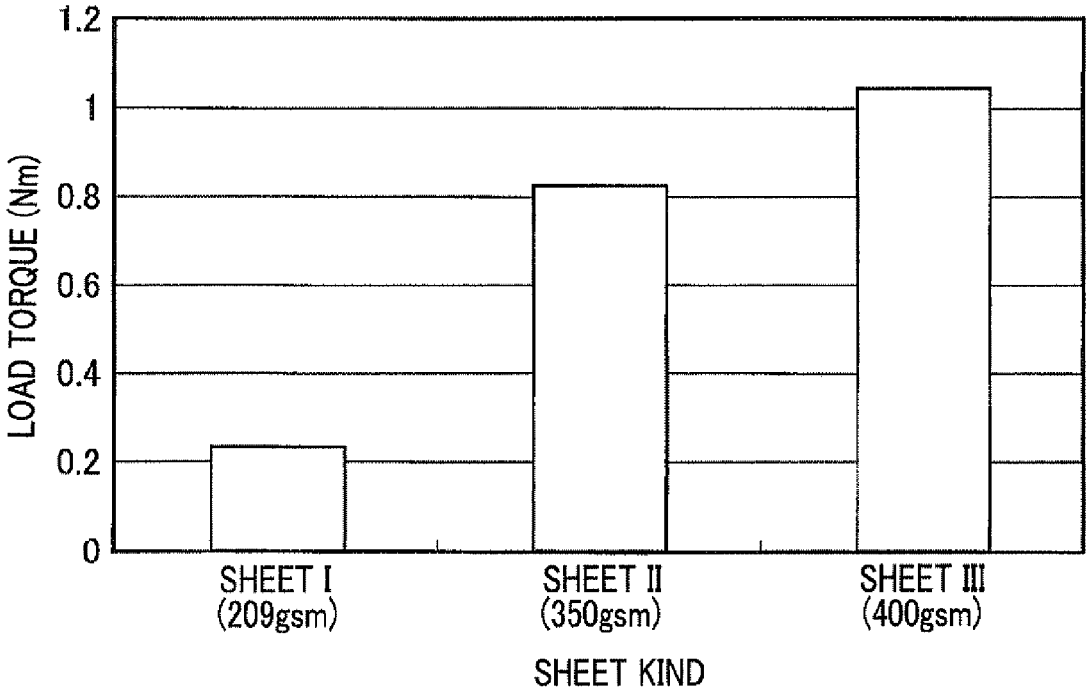
FIG. 11 is an explanatory diagram showing a relationship between a type of paper entering the transfer portion of the transfer unit and a load torque when the paper enters the transfer portion.

First, in order to estimate performance of the imaging forming apparatus according to the present example, an intermediate transfer type image forming apparatus for test having a basic configuration similar to that of the present example is used, a relationship between a paper type and load fluctuation when the paper enters the transfer portion of the secondary transfer unit is examined, and results shown in FIG. 11 are obtained.

In FIG. 11, Papers I to III are as follows.

Paper I: basic weight 209 gsm

Paper II: basic weight 350 gsm

Paper III: basic weight 400 gsm

According to FIG. 11, if paper (paper I) having the basis weight of about 200 to 250 gsm which is used in the printing of an electrophotographic technology in the related art and a paper (paper II and III) having a greater basis weight of about 350 to 400 gsm are compared, it is understood that the load torque of four to five times in the papers II and III is generated compared to the paper I.

Speed Fluctuation of Transfer Belt When Paper Enters

Figure 12:
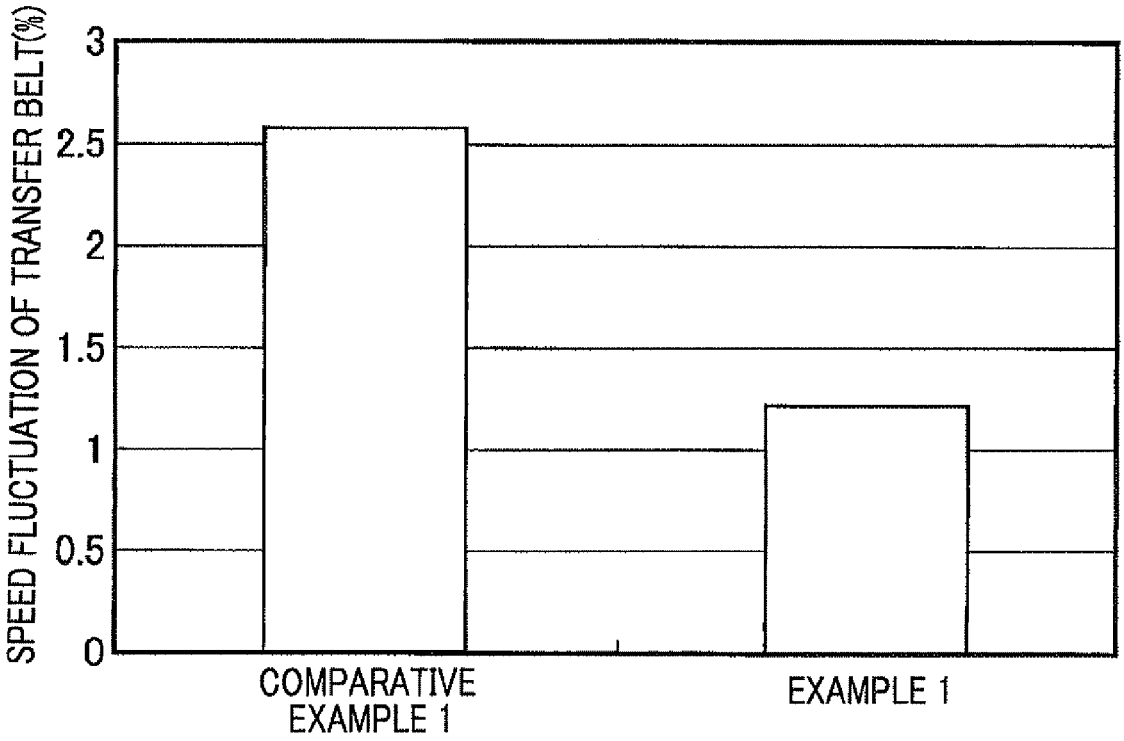
FIG. 12 is an explanatory diagram showing load fluctuation of the transfer belt in the transfer unit according to Example 1 and the transfer unit according to Comparative Example 1.

With respect to Example 1 and Comparative Example 1 (aspect in which the flywheel of Example 1 is removed), the speed fluctuation of the transfer belt is examined when the paper enters the transfer portion of the secondary transfer unit, and results shown in FIG. 12 are obtained.

In FIG. 12, embodied conditions are as follows.

Paper: basis weight 350 gsm

Transport Speed of Transfer Belt: 120 ppm (484 mm/s)

Amount of inertia of Flywheel: 690 $kg \cdot mm^2$

According to FIG. 12, it is understood that the speed fluctuation of the transfer belt in Example 1 is decreased to be about ½ of that of Comparative Example 1, and it is confirmed that the printed image is no problem. Specifically, streaky patterns are observed in the printed image in Comparative Example 1. However, in Example 1, this kind of streaky patterns are at an inconspicuous level (speed fluctuation of transfer belt is 1.5% or less in test).

Inertia Effect of Flywheel due to Roll Diameter of Tension Roll

Figure 13:
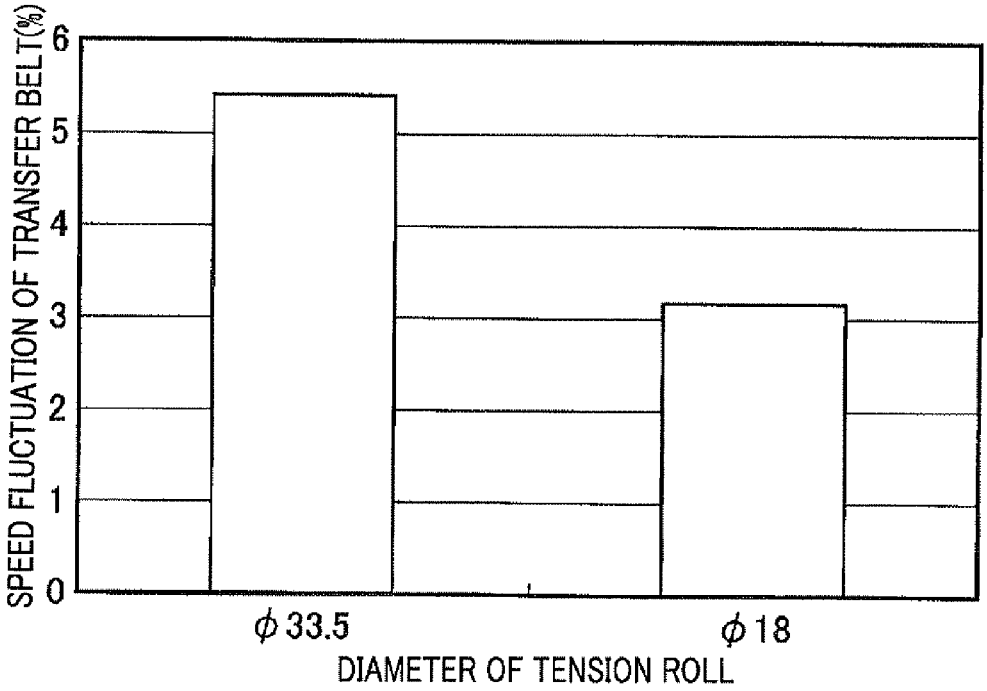
FIG. 13 is an explanatory diagram showing a relationship between a roll diameter of a tension roll equipped with a flywheel and the load fluctuation of the transfer belt in the transfer unit according to Example 1.

An intermediate transfer type image forming apparatus for test having a basic configuration similar to that of Example 1 is used, in the conditions in which the roll diameter of the tension roll to which the flywheel is added is changed, a load due to a brake instead of the load making the paper enter the transfer portion of the secondary transfer unit is input, and results shown in FIG. 13 are obtained.

Test conditions in FIG. 13 are as follows.

Transport Speed of Transfer Belt: 100 ppm (440 mm/s)

Amount of inertia of Flywheel: 1560 $kg \cdot mm^2$

According to FIG. 13, it is confirmed that the speed fluctuation of the transfer belt is further suppressed as the roll diameter of the tension roll to which the flywheel is added is smaller.

In addition, similar tests are preformed with respect to the changes of the transport speed of the transfer belt, the amount of inertia of the flywheel, and the roll diameter of the tension roll, and tendencies similar to the above-described those are observed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding member on which an image is held; and a transfer unit that transfers the image held on the image holding member to a recording material, wherein the transfer unit includes, a transfer roll that is disposed so as to be opposite to the image holding member, forms a transfer electric field between the transfer roll and the image holding member, and transfers the image of the image holding member to the recording material;

a drive unit that applies driving force to the transfer roll;

a torque limiting mechanics that is provided between the drive unit and the transfer roll and limits an upper limit of torque which acts on the transfer roll; and an inertia member that is a flywheel, the inertia member being provided so as to increase an amount of inertia with respect to the transfer roll and moving the transfer roll with inertia in a direction in which a speed difference between the image holding member and the transfer roll is decreased when the upper limit of torque acts on the transfer roll in the torque limiting mechanics.

2. An image forming apparatus comprising:

an image holding member on which an image is held; and a transfer unit that transfers the image held on the image holding member to a recording material, wherein the transfer unit includes, a transfer roll that is disposed so as to be opposite to the image holding member, forms a transfer electric field between the transfer roll and the image holding member, and transfers the image of the image holding member to the recording material;

a drive unit that applies driving force to the transfer roll;

one or a plurality of tension rolls that are disposed so as to be separated from the transfer roll and are provided so as to be rotatably driven;

a transfer belt that is hung over the transfer roll and the tension roll and circulates through the drive rotation of the transfer roll;

a torque limiting mechanics that is provided between the drive unit and the transfer roll and limits an upper limit of torque which acts on the transfer roll; and an inertia member that is a flywheel, the inertia member being provided so as to increase an amount of inertia with respect to at least any one of the tension rolls and moves the tension roll with inertia in a direction in which a speed difference between the image holding member and the transfer belt is decreased when the upper limit of torque acts on the transfer roll in the torque limiting mechanics.

3. The image forming apparatus according to claim 1, wherein the torque limiting mechanics is a mechanics that uses a torque limiter.

4. The image forming apparatus according to claim 2, wherein the torque limiting mechanics is a mechanics that uses a torque limiter.

5. The image forming apparatus according to claim 1, wherein the inertia member is provided so as to be coaxial with a support shaft of the transfer roll or the tension roll or is provided to a transmission shaft connected via a transmitting member.

6. The image forming apparatus according to claim 2, wherein the inertia member is provided so as to be coaxial with a support shaft of the transfer roll or the tension roll or is provided to a transmission shaft connected via a transmitting member.

7. The image forming apparatus according to claim 3, wherein the inertia member is provided so as to be coaxial with a support shaft of the transfer roll or the tension roll or is provided to a transmission shaft connected via a transmitting member.

8. The image forming apparatus according to claim 4, wherein the inertia member is provided so as to be coaxial with a support shaft of the transfer roll or the tension roll or is provided to a transmission shaft connected via a transmitting member.

9. The image forming apparatus according to claim 1, wherein the torque limiting mechanics sets an upper limit of a driving current of a motor that is the drive unit and limits an upper limit of the torque acting on the transfer roll or the tension roll.

10. The image forming apparatus according to claim 2, wherein the torque limiting mechanics sets an upper limit of a driving current of a motor that is the drive unit and limits an upper limit of the torque acting on the transfer roll or the tension roll.

11. The image forming apparatus according to claim 2, wherein the inertia member is provided in the tension roll, the tension roll having a smaller diameter than that of the transfer roll.

12. The image forming apparatus according to claim 2, wherein the transfer belt includes a resin or a metallic belt member.

13. The image forming apparatus according to claim 11, wherein the transfer belt includes a resin or a metallic belt member.

* * * * *